US005251793A

United States Patent [19]

Bolen, Jr. et al.

[11] Patent Number: 5,251,793

[45] Date of Patent: * Oct. 12, 1993

[54] DISPENSING CLOSURE

[76] Inventors: Robert J. Bolen, Jr., 10 Gwynne Ct., Closter, N.J. 07624; Thomas R. Bolen, 312 Dayton St., Ridewood, N.J. 07450

[ * ] Notice: The portion of the term of this patent subsequent to Feb. 19, 2008 has been disclaimed.

[21] Appl. No.: 656,309

[22] Filed: Feb. 15, 1991

Related U.S. Application Data

[63] Continuation of Ser. No. 493,828, Feb. 19, 1991, Pat. No. 4,993,606, which is a continuation of Ser. No. 214,676, Jul. 1, 1988, abandoned.

[51] Int. Cl.[5] ..... B65D 47/08

[52] U.S. Cl. ..... 222/546; 222/556

[58] Field of Search ..... 222/498, 517, 534, 546, 222/556; 215/235, 237; 220/335, 338

[56] References Cited

U.S. PATENT DOCUMENTS

| | | | |
|---|---|---|---|
| 2,690,861 | 10/1954 | Tupper . | |
| 2,851,203 | 9/1958 | Nowak . | |
| 3,124,281 | 3/1964 | Stull . | |
| 3,204,829 | 9/1965 | Song . | |
| 3,240,405 | 3/1966 | Abbott . | |
| 3,575,324 | 4/1971 | Hazard . | |
| 3,718,238 | 2/1973 | Hazard et al. | 222/556 X |
| 3,877,598 | 4/1975 | Hazard . | |
| 4,022,352 | 5/1977 | Pehr . | |
| 4,047,495 | 9/1977 | O'Brien . | |
| 4,158,902 | 6/1979 | Chernack et al. . | |
| 4,220,248 | 9/1980 | Wilson . | |
| 4,244,495 | 1/1981 | Lorscheid et al. . | |
| 4,261,486 | 4/1981 | Bush . | |
| 4,281,778 | 8/1981 | Stull . | |
| 4,358,032 | 11/1982 | Libit . | |
| 4,377,247 | 3/1983 | Hazard et al. . | |
| 4,377,248 | 3/1983 | Stull . | |
| 4,399,928 | 8/1983 | Klinger . | |
| 4,441,637 | 4/1984 | Libit | 220/335 X |
| 4,463,882 | 8/1984 | Hammett . | |
| 4,513,888 | 4/1985 | Curry . | |
| 4,625,898 | 12/1986 | Hazard . | |
| 4,666,068 | 5/1987 | Bush | 222/556 X |
| 4,699,301 | 10/1987 | Blake . | |
| 4,742,928 | 5/1988 | Braun | 220/335 X |
| 4,993,606 | 2/1991 | Bolen, Jr. et al. | 222/556 X |

FOREIGN PATENT DOCUMENTS

| | | |
|---|---|---|
| 2948184 | 12/1984 | Australia . |
| 6816987 | 8/1987 | Australia . |
| 203043 | 1/1983 | New Zealand . |
| 8204028 | 11/1982 | PCT Int'l Appl. . |
| 2166123 | 4/1986 | United Kingdom . |

*Primary Examiner*—Kevin P. Shaver
*Attorney, Agent, or Firm*—Davis Hoxie Faithfull & Hapgood

[57] ABSTRACT

A two piece dispensing closure for a container having an internally threaded base with a dispensing orifice in the front section and an elevated rear land that has a pivot recess adapted to receive a separate lid that rotates at least 90° from the closed position. The front section of the lid is generally circular with a pivot post at its rear, and when closed the upper surfaces of the lid and base are co-planar, and the closure has the appearance of a conventional screw cap.

7 Claims, 2 Drawing Sheets

DISPENSING CLOSURE

The present application is a continuation of U.S. Ser. No. 07/493,828, which issued on Feb. 19, 1991 as U.S. Pat. No. 4,993,606, which is a continuation of U.S. Ser. No. 07/214,676, abandoned.

BACKGROUND OF THE INVENTION

The present invention relates generally to a dispensing closure for containers and more particularly to a two piece dispensing closure, wherein a hinged lid is moved from a base of the closure to uncover an orifice through which the container contents are dispensed. This type of closure is made from molded plastic and used extensively in dispensing food products, such as salad dressings, and for personal care and household products.

The typical dispensing closure for a container comprises a generally circular base with a dispensing orifice in the front section of the upper surface and an annular skirt depending downwardly from the upper surface that is adapted to engage and secure the base to the container, usually by means of internal threads that are screwed onto the neck of the container. A lid having a plug on its underside for sealing the dispensing orifice is adapted to be pivotally moved with respect to the base to be opened and closed by the pressure of the finger or thumb.

In many instances the base and lid of the closure are molded as a single unit, the lid being connected to the base by a flexible hinge, which is known in the industry as a "living hinge". A disadvantage of the "living hinge" is that the hinge portion of the closure has a tendency to crack, and eventually break, separating the lid from the base. Also, when the lid is rotated from the open position, it reaches a point from which it tends to snap rapidly to the closed position, and can splash liquid product, or even catapult one or more drops toward the user's face or clothing, thus presenting some danger if the product is an irritant.

Moreover, in the "living hinge" design, at least a portion of the hinge necessarily extends beyond the circumferential periphery of the closure of the rear of the base and creates problems during the assembly line filling of the container in that such an eccentric shape is subject to bumping and breakage, and can interfere with the highly automated equipment used during assembly of the closure and container of the product to be marketed.

The "living hinge" design has been replaced to some extent by a dispensing closure design where the base has a notch located at the approximate center of top, and a relatively narrow rectangular channel extends from the notch to the front edge of the base with a dispensing orifice positioned in the channel proximate the front edge. A lid having a generally flat upper surface which terminates in a downwardly depending flange and indented end pieces is adapted to be received in a snap-fit into the notch, and when rotated to the closed position, lies entirely within the channel. The underside of the lid has an annular plug which mates with, and seals the orifice. The lid is maintained in the open position by means of an interference fit between the bottom edge of the flange and lugs located at the forward edge of the bottom of the notch where it intersects the rear of the channel. The lid is maintained in the notch in the open position by contact between a groove in the leading edge of the flange and a tab protruding upwardly from the intersection of the front wall and bottom of the notch.

Another type of dispensing closure has been developed where the base and a dispensing nozzle, or spout, comprise two separate components that are interconnected through a modified ball and socket joint, or protruding pin or post from one component mating with a corresponding recess in the other component to form a pin/recess hinge structure between the two components. In one form of the pin/recess hinge design, the outer surface of the base of the closure has a notch formed therein, said notch being shaped to receive one end of a hollow dispensing type nozzle of lid which has a passageway for the liquid product. In the fully open position the nozzle communicates with the inside of the container by means of an orifice through the base located in the bottom of the notch. The nozzle end portion mates in a modified ball and socket configuration when press fit into the notch in the base. This latter ball and socket hinge design further relies upon a key-slot configuration in the notch of the base and the portion of the dispensing nozzle to be disposed within the notch, respectively, to limit the open position of the dispensing nozzle type lid, as well as interfering projections on the forward face of the notch and on the portion of the nozzle disposed within the notch to maintain the nozzle in an open position during the dispensing of product from the container. The interference fit yields to finger pressure to move the nozzle through the interference fit and return the lid to a closed position on the base of the closure.

In another form of two piece dispensing closure, the lid is circular and the end of the lid opposite the orifice contains two slots which mate with two posts extending upwardly from the surface of the base of the circular closure at its periphery. In this slot and post design, the posts are flexible and exposed, and are therefore subject to damage during handling of the closure or container. In addition, the lid is insecurely held in place, is subject to twisting and lateral movement, and is easily pulled from the posts when the lid is in the open position.

The closure of this invention is an improvement over these prior art closures.

It is a principal object of the invention to provide a two piece dispensing closure which has a hinge structure that provides a smooth peripheral symmetry, a planar top, and one which is less susceptible to damage than existing dispensing closures.

A further object to the present invention is the provision of a two piece dispensing closure which is simple in construction, pleasing in appearance and capable of a long, useful service life.

It is another object of the invention to provide a container closure in which the lid will remain in the open position and resist closing even when the container is inverted and vigorously shaken.

Another object of the invention is to provide a dispensing closure with a lid that remains in a stable working position without cracking or separating from the base.

It is yet another object of this invention to provide a closure in which there is an interference fit between the lid and the base as the lid is rotated to its fully open position, so that at least a perceptible finger pressure is required to move the lid to the closed position.

It is also an object of this invention to provide a dispensing closure which will permit the contents of the container to be secured from tampering after filing and which will have a smooth underside free from crevices and openings which may become contaminated.

With these and other objects in view, as will be apparent to those skilled in the art, the invention resides in the combination of parts set forth in the specification and covered by the claims appended hereto.

SUMMARY OF THE INVENTION

In its broadest aspect, the invention comprises a two piece dispensing closure for a container comprising a generally circular base with a dispensing orifice in the front section of the upper surface and an annular skirt depending downwardly from the upper surface which is adapted to engage and secure the base to the container, and a separate lid having a plug on its underside for sealing the dispensing orifice and adapted to be pivotally assembled to the base to open and seal the dispensing orifice, and the improvements comprising an elevated rear land section extending upwardly from and across the surface of the base opposite the dispensing orifice that is joined to the base by a transverse abutting wall, and a pivot recess in the elevated rear land adapted to pivotally receive the lid. The improved lid of the invention comprises a generally circular front section and a rearwardly extending, downwardly depending pivot post adapted to fictionally engage the pivot recess in the elevated rear section. The generally circular front section of the lid terminates along a chord, or transverse line, proximate the upper edge of the abutting wall, and the upper surfaces of the closed lid and the elevated rear section of the base are co-planar, i.e., the closed lid is flush with the elevated rear land. The pivot recess in the base is configured with an outwardly inclined rear wall, (i.e., the wall which is closest to the periphery of the closure), and an opposing front wall which is configured to permit free opening of the lid, i.e., without frictional interference between the front wall of the recess and the pivot post of the lid.

In one preferred embodiment, the pivot recess in the elevated rear land portion of the base and the pivot post of the lid are configured to provide an interference fit between the rear wall of the recess and the pivot post of the lid as the lid is rotated to the open position.

Further, the plug on the lid has means for securing the lid to the dispensing orifice in the base when it is pressed firmly into the closed position.

The closure can be molded from any of a variety of resilient polymeric materials well known to those in the art, including polypropylene, polyethylene and polyvinylchloride and copolymers and blends of said polymers.

BRIEF DESCRIPTION OF THE DRAWINGS

The invention will be best understood by reference to one of its structural forms, as illustrated by the accompanying drawings, in which.

DESCRIPTION OF THE PREFERRED EMBODIMENT

Figure 1:
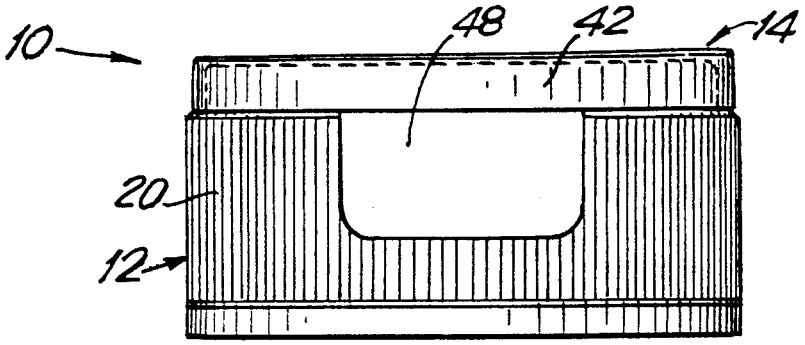
FIG. 1 is a front elevational view of a two piece dispensing closure embodying the features of the present invention.
Figure 2:
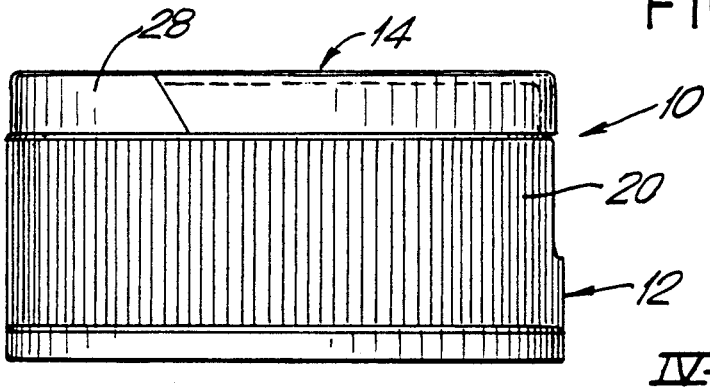
FIG. 2 is a left hand elevational view of the closure.
Figure 3:
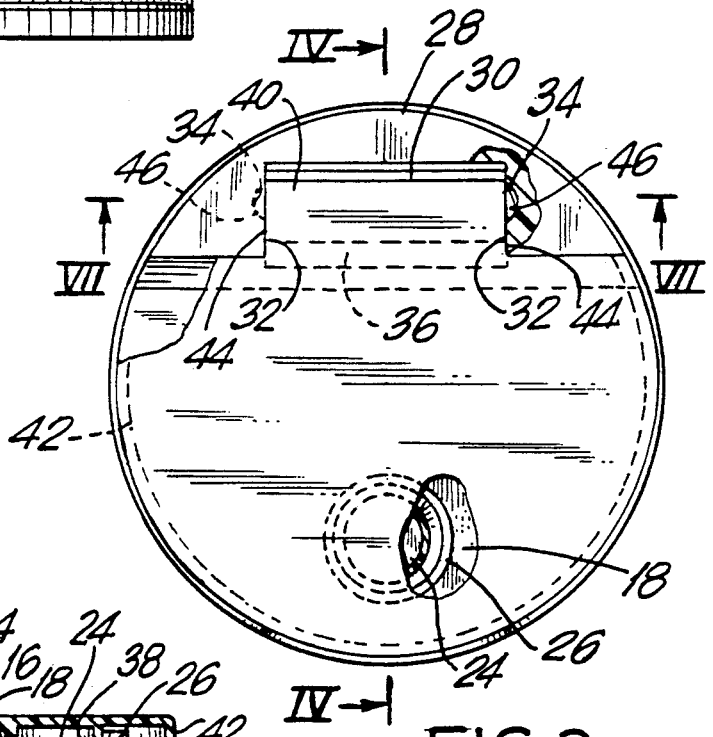
FIG. 3 is a plan view of the closure, with cut-away sections.

Referring to the drawings, the two piece dispensing closure of the present invention is generally indicated by reference numeral 10 and comprises a base which is generally indicated by the reference numeral 12 and a lid which is generally indicated by the reference numeral 14. The base 12 includes a circular cover portion 16 which has a generally semi-circular forward top surface 18 and an annular skirt, or side wall, 20 which is provided with internal threads 22 to enable the cap to be threaded onto the threaded neck of a container.

Other means of affixing the closure to a container may be employed. Such means are well known to those skilled in the art. The cover portion 16 of the base 12 has dispensing orifice 24 having an upstanding annular rim 26.

The cover portion 16 has an elevated rear land section 28 extending upwardly above the annular skirt 20, on the side of the cover portion 16 disposed over the dispensing orifice 24. The land portion 28 has a substantially rectangular pivot recess 30. The pivot recess 30 is defined by a pair of vertical side walls 32, each wall 32 having a circular indent 34, a rear wall 31, and an outwardly sloping front wall 35 forming a portion of a ridge 36. The height of the ridge 36 is slightly less than the height of the elevated rear section 28 in order to accommodate the thickness of the lid, as described in detail below, to provide a uniformly flat upper surface to the closure when the lid is in the closed position.

Figure 4:
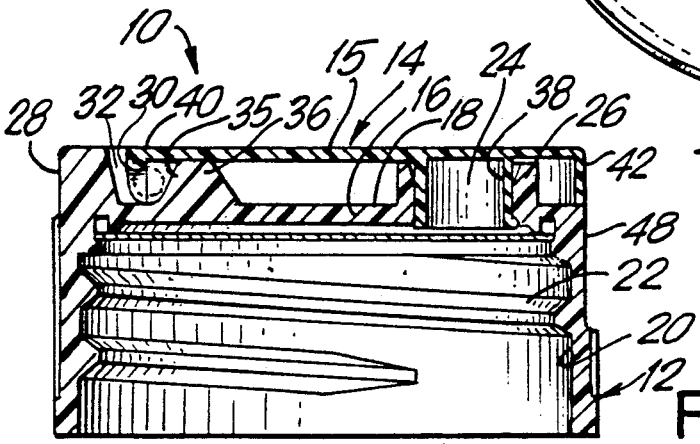
FIG. 4 is a vertical cross-sectional view of the closure taken along line IV—IV of FIG. 3, and looking in the direction of the arrows.
Figure 5:
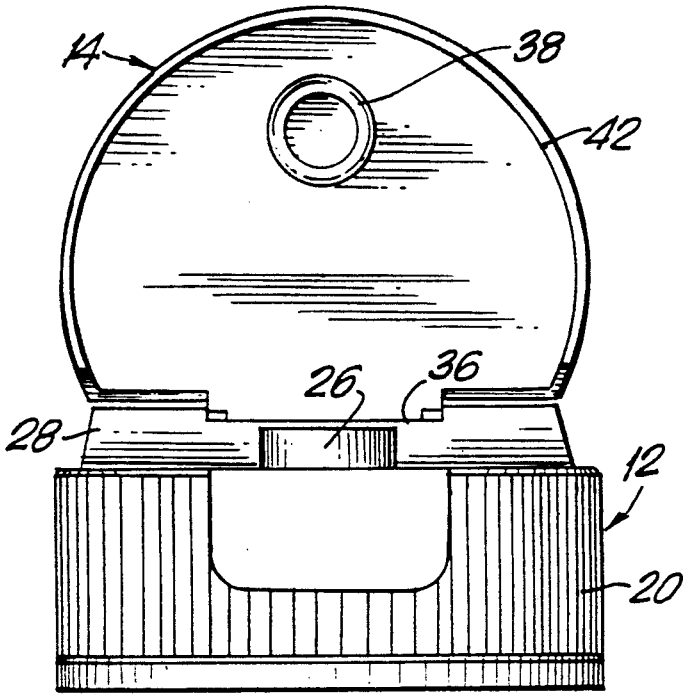
FIG. 5 is a front elevational view of the closure with the lid in the open portion.
Figure 6A:
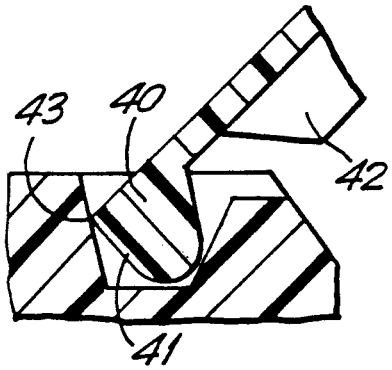
FIG. 6A is an enlarged sectional view of the hinge portion of the closure of FIG. 6.
Figure 6B:
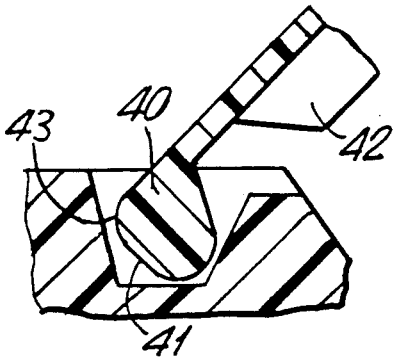
FIG. 6B is an enlarged sectional similar to FIG. 6A, illustrating a different embodiment of the lid.
Figure 6:
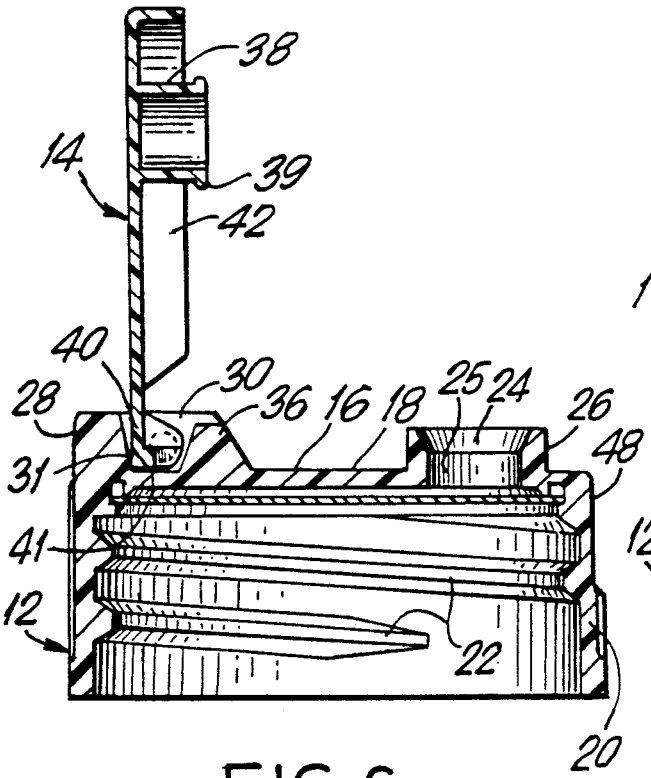
FIG. 6 is a vertical cross-sectional view similar to FIG. 4, and showing the lid in the open position.
Figure 7:
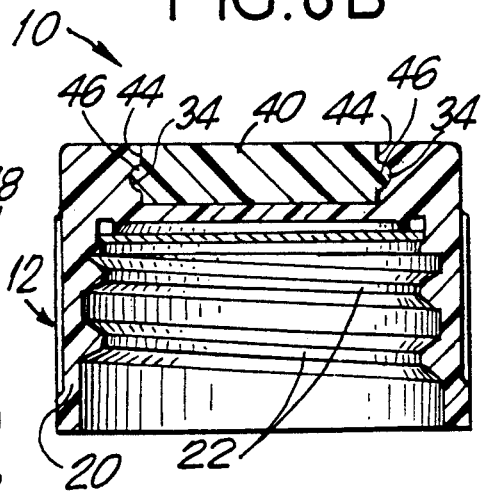
FIG. 7 is a vertical cross-sectional view of the closure taken along the line VII—VII of FIG. 3, and looking in the direction of the arrows.

The lid 14 has a top port and a skirt portion 42 that is best shown in FIGS. 5 & 6. The skirt portion closes down on the periphery of the base 12 when the lid 14 is in the closed position. The surface of the lid 14 follows the contour of the top surface of the base 12. The lid 14 is further provided with an annular plug 38 which extends downwardly from the bottom surface of the lid so that it mates with and seals the orifice 24 when the lid is in the closed position as shown in FIG. 4. The end of plug 38 is preferably provided with a bead, or flange, 39 that provides a secure interference fit with the narrowed throat 25 as it is pressed into orifice 24.

At the opposite end of the lid, pivot post 40 is dimensioned so as to be securely received in recess 30, and terminates in an end portion which has side surfaces 44, each surface having a spherical, or rounded, projection 46 which compliments and is snapped into the indents 34 in each of the side walls of the recess 30. The combination of projections 46 and indents 34 forms a hinge connection between the lid 14 and the base 12, and can be reversed so that one or both of the indents are on the pivot post of the lid. This configuration enables the lid 14 to be pivoted from a closed position as shown in FIG. 4, in which the lid is flush with the top surface **18*a* of the rear land 28 and the orifice 24 is sealed by the plug 38**, to an open position* shown in FIG. 6, in which the lid is at least 90° from the position shown in FIG. 4. When the lid 14 is in the closed position as shown in FIG. 4, the top surfaces of the lid 14, including the pivot post 40, and the elevated section 28, all lie in the same horizontal plane. In addition, the configuration also provides the means for securely holding the cap in the base.

When the lid is in closed position, the skirt of the lid continues the line of the side wall of the elevated rear section, or land, to give the appearance of a continuous vertical wall to the closure. The longitudinal and vertical continuity of the closure thus provides an aesthetically pleasing appearance, and to some degree provides a child-resistant safety feature in that the means of gaining entry to the container contents is not immediately apparent. Moreover, the defined structure has the appearance of a one piece cylindrical cap. With the elevated rear section design of the subject closure and a lid covering a limited portion of the surface of the base, a dispensing orifice having an annular rim of substantial height may be used. It is desirable to have the rim defining the pour orifice of substantial height to permit cleaner dispensing that is less prone to dripping. Also, the hinge elements of the closure are well protected within the confines of the recess 30, and the underside of the base is planar.

An important aspect of the structure of the closure of the subject invention resides in the hinge interconnection of the lid 14 and the base 12 at recess 30. It is desirable that the rear wall 31 of the recess 30 be substantially flat so as to provide a surface against which the upper surface of the pivot post 40 may abut in the open position. This abutment, together with the stable frictional interfit of the projections and indents of the hinge, provides a rigid mounting that is substantially aided in retaining its lateral stability due to inability of the side walls of the recess to move away from the mating side walls of the pivot post. This interfit stability is far superior to the relatively unstable interfit between the posts and lid of the prior art in which the open lid can easily be separated from the base.

In a preferred embodiment of the invention mostly clearly shown in the detail of FIG. 6A, the lower terminus of pivot post 40 is generally circular in cross section, with a tangential surface intersecting the upper surface of the pivot at essentially a right angle along edge 43. As the lid is rotated from the closed position, edge 43 of the pivot post 40 contacts the rear wall 31 in an interference fit and then again freely rotates to the fully open position. This interference fit prevents the open lid from closing unless a slight finger pressure is applied. This feature is most desirable when dispensing products from the container with an accompanying shaking motion, which would otherwise tend to move the lid to a closed position. If this occurred during dispensing so as to interfere with the flow path of the product, the undesired consequences are obvious—the product would likely be directed to the user rather than the zone of desired impingement. This means for retaining the lid in the open position also eliminates the potential for splashing which can occur with the spring action "living hinge" of the prior one-piece closures which snap to a closed position. This interference fit is thus accomplished in general by employing an eccentric-concentric design for the rear wall of the recess and pivot post end.

Also as best illustrated in FIG. 6A, the rear wall 31 is inclined from the vertical toward the rear of the base to permit the cap to be opened more than 90° from the closed position. As will be apparent to those skilled in the art the extent of the incline of the rear wall 31 can be from a few degrees up to 45°, depending upon the geometry of the recess, the relative position of the pivot post in the recess, and the maximum angle desired between the lid and the upper surface of the base. In general, it is desirable from the stand point of utility, as well as ease of molding of the base part, that the rear wall 31 make an angle of at least 90° with the base, and most preferably, an angle of from 100° to 120° with the base.

FIG. 6B illustrates another modification of the pivot post in which the rear edge 51 of the lid is rounded, so that there is no interference fit with the rear wall 31 as the lid is raised and lowered. In the configuration of FIG. 6B, the lid is maintained in the open position by virtue of the frictional fit of the ends of the pivot post in the recess.

As will also be appreciated by one skilled in the art the configurations of the recess and pivot post can be modified in various ways to produce the functionally equivalent relationship with the base of the closure. Thus, the pivot post can take the configuration which more nearly resembles a conventional ball joint and the recess likewise modified to the shape of a socket adapted to receive the ball. Other configurations known in the art can be adapted to configure the downwardly depending extension 40 from the rear of the generally circular front section 15 of the lid 14 to mate with the pivot recess 30 in a hinge relationship which has a center of rotation located within the recess.

As will be apparent from the drawings, the axis of rotation of the lid is along a chord, or line, which is perpendicular to the diameter passing through the center of the dispensing orifice. Further, the axis of the recess is displaced on the opposite side of a diameter drawn between the recess and the dispensing orifice. In a preferred embodiment, the length of the recess along the axis of rotation is approximately one-third to one-half the diameter of the closure and it is located at a distance of approximately two-thirds to three-quarters of the diameter from the front skirt or wall of the closure nearest the dispensing orifice.

The configuration of the abutting wall is not critical, and as shown in FIG. 6A, is inclined from the vertical toward the rear, which provides an aesthetically pleasing appearance and facilities removal of the base from the mold.

In addition, the base skirt 20 is provided with knurling to facilitate removal, and the upper surfaces of the base and lid can be embossed during molding with decorative designs, the brand name of the product and instructions for use.

Although the closure is illustrated with internal threads, other means such as bayonet lugs and channels, or a snap-fit bead and recess, can be employed to secure the closure to the container.

The configuration of the closure with the elevated rear land with the pivot recess disposed therein permits an inner safety seal to be installed on the container in contact with the underside of the base. Typically, the circular foil and polyethylene seal is placed inside the closure base, which is then screwed onto the container and then treated ultrasonically to melt and fuse the seal to the upper rim of the container. In closures wherein the hinge structure extends beneath the underside of the cover portion, the placement of an inner seal on the container is foreclosed. Moreover, disposing the hinge structure of the closure out of contact with the container contents avoids potential product contamination.

Referring particularly to FIGS. 1 and 4, the front of the annular skirt 20 is provided with a recess 48 at the juncture of the base skirt 20, and the upper surface 16. The downwardly extending lid skirt 42 overhangs the annular side wall 20 above the recess 48, as shown in FIG. 4, to facilitate raising of the lid 14 by the user's finger or fingernail.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

We claim:

1. A two-piece dispensing closure for a container, the closure comprising:

a generally circular base having a top and a front section, the base comprising a cover portion at least partially spanning the top of the base and having a generally semi-circular forward top surface in the front section of the base, and an annular skirt depending downwardly from the cover portion;

a dispensing orifice in the generally semi-circular forward top surface of the cover portion, wherein the dispensing orifice has a rim and the top surface portion does not extend above the rim;

a lid having a plug on its underside for sealing the dispensing orifice; and an elevated rear land extending upwardly from and above the annular skirt, contiguous with the generally semi-circular forward top surface of the cover portion and behind the dispensing orifice, the elevated rear land having a pivot recess spaced from its periphery for pivotally receiving the lid, the pivot recess being disposed to align the plug with the dispensing orifice and thereby allow mating of the plug and orifice when the lid is in the closed position.

2. The dispensing closure of claim 1 wherein a surface of the lid follows a contour of the top surface of the cover portion of the base.

3. The dispensing closure of claim 1 wherein the lid further comprises a downwardly depending skirt which extends from proximate the elevated rear land when the lid is closed and encloses the area under the closed lid.

4. A two-piece dispensing closure for a container, the closure comprising:

a generally circular base having a top and a front section, a cover portion at least partially spanning the top of the base and having a generally semi-circular forward top surface in the front section of the base, and an annular skirt depending downwardly from the cover portion;

a dispensing orifice in the generally semi-circular forward top surface of the cover portion, wherein the dispensing orifice has a rim and the top surface does not extend above the rim;

a lid having a plug on its underside for sealing the dispensing orifice, wherein a surface of the lid follows a contour of the top surface of the cover portion;

an elevated land extending upwardly from and above the annular skirt, contiguous with the generally semi-circular forward top surface of the cover portion and rearward of the dispensing orifice, the elevated land having a pivot recess spaced from its periphery for pivotally receiving the lid, the pivot recess being disposed to align the plug with the dispensing orifice and thereby allow mating of the plug and orifice when the lid is in the closed position.

5. The dispensing closure of claim 4 wherein the lid further comprises a downwardly depending skirt which extends from proximate the elevated land when the lid is closed and encloses the area under the closed lid.

6. The dispensing closure of claims 1 and 4 wherein the lid comprises a pivot post adapted to frictionally engage the recess in the elevated land.

7. The dispensing closure of claim 6 wherein the pivot recess has side walls adapted to frictionally engage the pivot post.

* * * * *